US005357926A

United States Patent [19]

Hu

[11] Patent Number: 5,357,926

[45] Date of Patent: Oct. 25, 1994

[54] COMPRESSION RELEASE ENGINE BRAKE WITH SELECTIVELY REDUCED ENGINE EXHAUST NOISE

[75] Inventor: Haoran Hu, Farmington, Conn.

[73] Assignee: Jacobs Brake Technology Corporation, Wilmington, Del.

[21] Appl. No.: 112,766

[22] Filed: Aug. 26, 1993

[51] Int. Cl.[5] ..... F01L 13/06

[52] U.S. Cl. ..... 123/321

[58] Field of Search ..... 123/320, 321, 322, 90.16

[56] References Cited

U.S. PATENT DOCUMENTS

| | | | |
|---|---|---|---|
| 3,220,392 | 11/1965 | Cummins | 123/321 |
| 4,398,510 | 8/1983 | Custer | 123/90.16 |
| 4,423,712 | 1/1984 | Mayne et al. | 123/321 |
| 4,592,319 | 6/1986 | Meistrick | 123/321 |
| 5,000,145 | 3/1991 | Quenneville | 123/321 |
| 5,048,480 | 9/1991 | Price | 123/321 |
| 5,161,501 | 11/1992 | Hu | 123/321 X |
| 5,186,141 | 2/1993 | Custer | 123/321 |

*Primary Examiner*—Willis R. Wolfe
*Attorney, Agent, or Firm*—Robert R. Jackson

[57] ABSTRACT

In order to make the use of compression release engine brakes on the internal combustion engines of vehicles more acceptable in areas (e.g., urban areas) where high levels of engine exhaust noise are undesirable, the operator of the vehicle can adjust the "lash" of the engine brake to reduce engine exhaust noise whenever desired. The "lash" of the engine brake is the "at rest" clearance between engine brake slave piston and the engine exhaust valve mechanism operated on by the slave piston to produce engine braking. Engine exhaust noise associated with engine braking is reduced by reducing this lash or clearance so the engine brake opens exhaust valves in the engine at lower engine cylinder pressures, thereby reducing the associated exhaust noise. Despite the reduced exhaust noise, the engine brake still provides a substantial amount of engine braking horsepower.

13 Claims, 2 Drawing Sheets

COMPRESSION RELEASE ENGINE BRAKE WITH SELECTIVELY REDUCED ENGINE EXHAUST NOISE

BACKGROUND OF THE INVENTION

This invention relates to compression release engine brakes, and more particularly to selectively reducing the engine exhaust noise associated with the use of such engine brakes.

Compression release engine brakes for internal combustion engines are well known as shown, for example, by Cummins U.S. Pat. No. 3,220,392. Such engine brakes typically operate by using an appropriately timed mechanical motion in one part of the associated internal combustion engine to open an exhaust valve in an engine cylinder whose piston is near top dead center of its compression stroke while the fuel supply to the engine is cut off. Opening the exhaust valve in this way allows the gas (air) that the piston has compressed to escape into the exhaust manifold of the engine. This prevents the engine from recovering the work of compressing that gas during the subsequent "power" stroke of the piston. In effect, the engine brake temporarily converts the engine from a power source to a power-sinking gas compressor. The engine can thus absorb more of the kinetic energy of the engine and the vehicle powered by that engine, thereby helping to slow down the vehicle. This conserves use of the vehicle's conventional wheel brakes, which prolongs the life of the wheel brakes and increases the safety of operation of the vehicle.

The abrupt opening of the engine exhaust valves produced by the engine brake while the gas in the associated engine cylinders is highly compressed tends to produce a relatively loud, staccato, "popping" sound in the engine's exhaust system. The amplitude of this sound may be almost as great as the "roar" of the engine exhaust when the engine is at full throttle in powering mode. In addition to being thus quite loud, the rapid, more discrete "pops" of the exhaust noise caused by operation of the engine brake may make that noise more annoying than the steadier roar of power mode engine exhaust. Neither of these kinds of exhaust noise may be particularly troublesome on the open road, but there are areas in which they may be objectionable to some people. For example, some urban areas have attempted to regulate or even preclude the use of compression release engine brakes because of objections to the engine exhaust noise they cause.

In view of the foregoing, it is an object of this invention to reduce the engine exhaust noise associated with the use of compression release engine brakes.

It is another object of this invention to provide a compression release engine brake that can be switched to a substantially quieter, but still effective mode of operation when desired.

SUMMARY OF THE INVENTION

These and other objects of the invention are accomplished in accordance with the principles of the invention by providing a compression release engine brake which can be switched, whenever desired, between a normal mode of operation (in which full engine braking is provided) and a quieter mode of operation (in which less than full engine braking is provided but in which the associated engine exhaust noise is greatly reduced). In the normal mode the engine brake is set so that the exhaust valves in the associated internal combustion engine are opened by the engine brake mechanism relatively close to top dead center of the compression strokes of the engine cylinders. For example, in this mode the exhaust valve or valves in an engine cylinder may be opened at an engine crank angle of approximately 20°–30° prior to top dead center for that cylinder's compression stroke. In the quieter mode of engine brake operation the exhaust valve openings may be advanced relative the normal mode. For example, in the quieter mode the exhaust valve openings may be advanced to approximately 60°–70° prior to top dead center. This still provides approximately one-half to two-thirds of the normal mode engine braking, but it causes much less engine exhaust noise because the gas in the engine cylinders is not compressed to such a high pressure before being released to the engine exhaust system. The choice of normal or quieter engine brake mode is preferably under control of the operator (driver) of the associated vehicle so that he or she can switch between these modes whenever desired.

Further features of the invention, its nature and various advantages will be more apparent from the accompanying drawings and the following detailed description of the preferred embodiments of the invention.

DETAILED DESCRIPTION OF THE PREFERRED EMBODIMENTS

Figure 1:
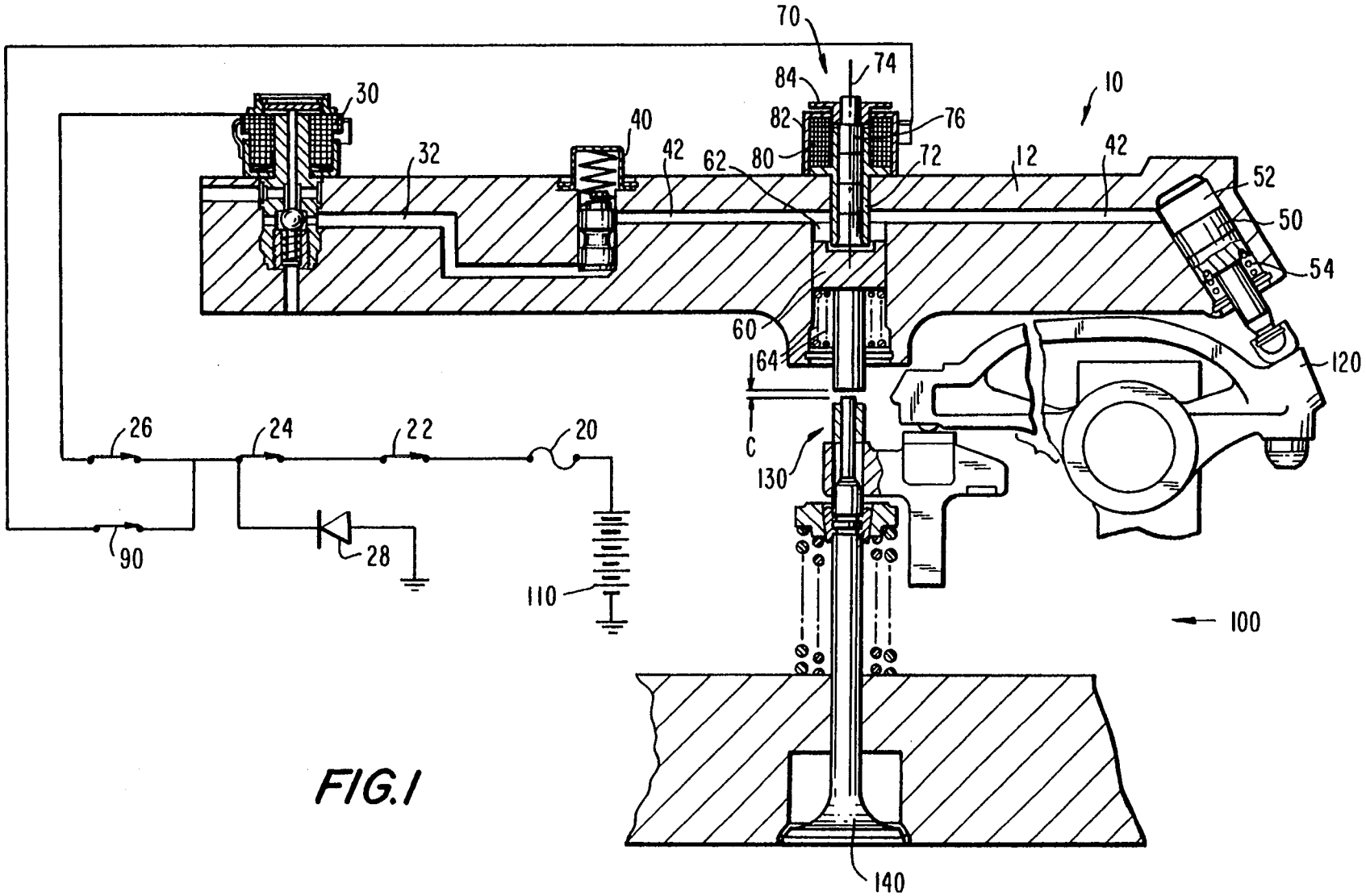
FIG. 1 is a simplified view, partly in section, of a portion of an illustrative compression release engine brake constructed in accordance with the principles of this invention. Portions of the internal combustion engine associated with the engine brake are also shown in FIG. 1, and certain electrical controls are shown schematically in this FIG.

As shown in FIG. 1, an illustrative engine brake 10 constructed in accordance with this invention includes a housing 12 which is mounted above the internal combustion engine 100 with which the engine brake is associated. When engine brake 10 is turned on in normal mode (i.e., the mode which gives optimum engine retarding), conventional solenoid valve 30 is energized by a flow of electrical current from vehicle battery 110 through conventional fuse 20 and conventional closed switches 22, 24, and 26. Switch 22 is a clutch switch which ensures that the vehicle's transmission clutch is engaged before the engine brake can be made operative. Switch 24 is a fuel pump switch which ensures that the fuel supply to the engine is cut off before the engine brake can be made operative. And switch 26 is closed by the operator of the vehicle whenever it is desired to turn the engine brake on. Diode 28 is provided to smooth the operation of the above-described electrical circuit, particularly when it is turned off.

When solenoid valve 30 is energized, it maintains sufficient hydraulic fluid pressure in conventional low pressure hydraulic circuit 32 to operate conventional control valve 40. When thus operated, control valve 40 seals conventional high pressure hydraulic circuit 42, maintaining at least the low pressure of circuit 32 in the high pressure circuit. This initial low pressure in circuit 42 is sufficient to push conventional master piston 50 outwardly of master piston bore 52 into contact with the engine component 120 which provides the mechanical input to high pressure hydraulic circuit 42. In the depicted illustrative embodiment engine component 120 is a fuel injector rocker arm, but it could alternatively be any other suitably timed component of engine 100. When hydraulic circuit 42 is not pressurized as described above, master piston 50 is urged up out of contact with engine component 120 by conventional master piston return spring 54.

When master piston 50 is pushed out into contact with engine component 120 as described in the preceding paragraph, and while control valve 40 is preventing hydraulic fluid from escaping from high pressure circuit 42, each counterclockwise oscillation of engine component 120 further pressurizes the hydraulic fluid in circuit 42 and thereby causes conventional slave piston 60 to move downwardly in slave piston bore 62. This compresses conventional slave piston return springs 64 and closes the initial clearance, "lash", or gap C between the lower extremity of slave piston 60 and the portion of the engine exhaust valve mechanism 130 on which slave piston 60 acts in order to open engine exhaust valve 140. As soon as clearance C is closed, slave piston 60 begins to open exhaust valve 140, thereby releasing compressed gas from the engine cylinder associated with exhaust valve 140. This compressed gas typically leaves the engine via the exhaust manifold and exhaust system of the engine.

Although the timing of the exhaust valve openings produced by the engine brake may be different for different engines and different engine brakes, a fairly typical timing is to have exhaust valve 140 open at an optimized engine retarding crank angle of about 20°–30° before top dead center of the compression stroke of the engine piston in the cylinder served by exhaust valve 140. This produces high engine braking horsepower.

Figure 2:
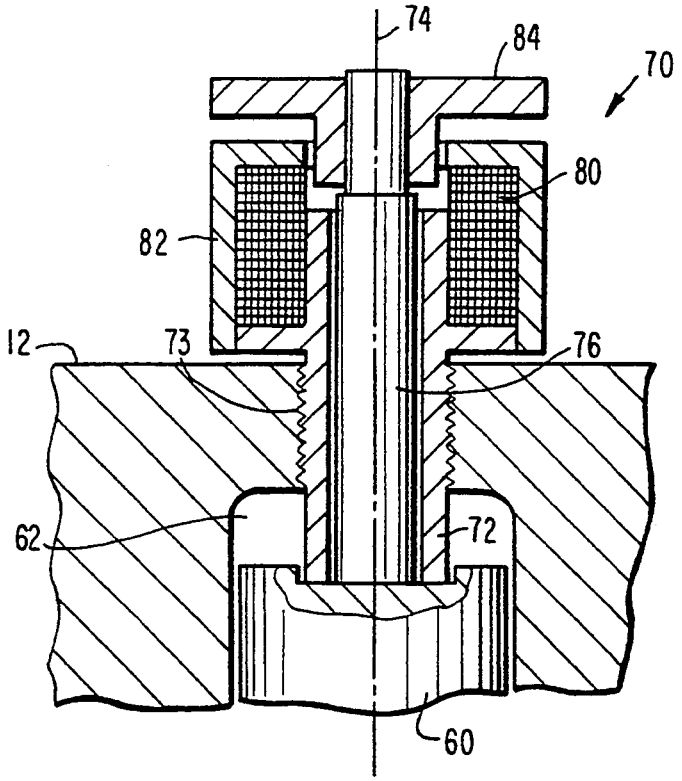
FIG. 2 is an enlargement of a portion of the apparatus shown in FIG. 1.

The dimension of clearance C is an important factor influencing the timing of the engine brake, and this dimension is typically determined by the location of a return stop for slave piston 60. The location of this return stop is set when the engine brake is installed and/or periodically adjusted. In the particular embodiment shown in FIG. 1, this return stop is the outer sleeve 72 of lash control mechanism 70. As is shown in more detail in FIGS. 2 and 3, this outer sleeve 72 of mechanism 70 is threaded (at 73) into housing 12 so that it can be made to extend into slave piston bore 62 by the desired amount above slave piston 60. A lock nut (not shown) may be provided to lock sleeve 72 in the desired location. In the absence of a high pressure hydraulic pulse from master piston 50, slave piston return springs 64 keep slave piston 60 pressed against sleeve 72. The axial location of sleeve 72 (along the axis of reciprocation 74 of slave piston 60) therefore determines the size of clearance C and the engine crank angle at which exhaust valve 140 is opened to produce each compression release event.

Although opening exhaust valve 140 at an engine crank angle relatively close to top dead center of the associated engine piston (e.g., at about 20°–30° prior to top dead center) produces very powerful engine braking, it also involves opening exhaust valve 140 when the pressure in the associated engine cylinder is very high. This causes a very loud noise in the engine exhaust system each time valve 140 is opened. As has been mentioned, it is an object of this invention to reduce the level of this noise, while still allowing the engine brake to provide substantial engine braking. This is accomplished in accordance with the principles of the invention by including in mechanism 70 a movable central element 76 which can be extended from the bottom of sleeve 72 whenever it is desired to change clearance C. The detailed construction of mechanism 70 will now be described with reference to FIGS. 2 and 3. The similarity of mechanism 70 to structures shown in my concurrently filed, commonly assigned application Ser. No. 08/112,771, still pending, should also be noted.

Figure 3:
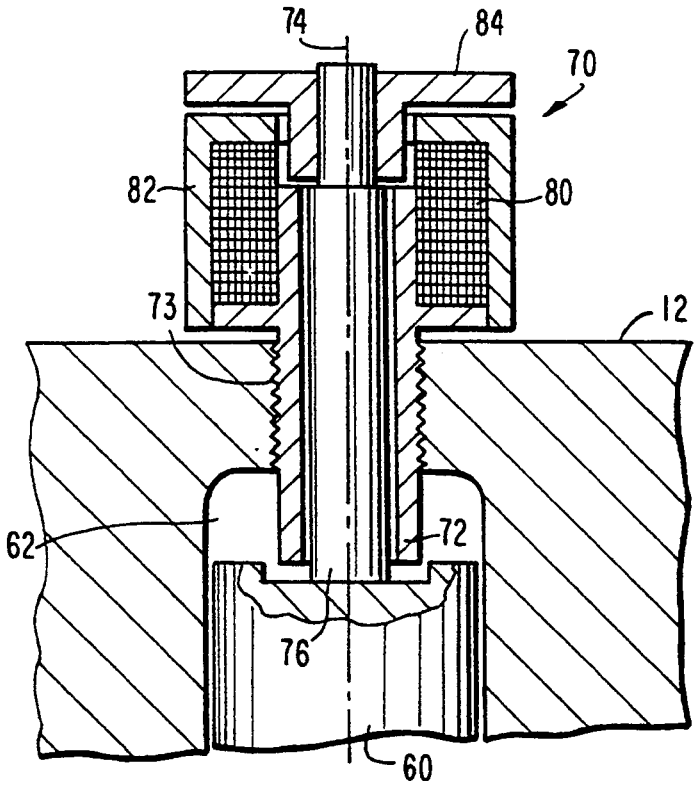
FIG. 3 is similar to FIG. 2, but shows another operating condition of the apparatus.

A solenoid coil 80 is wrapped around an upper portion of sleeve member 72. Inverted cup 82 fits over coil 80 and is secured to a radially outwardly extending flange of sleeve 72 to hold coil 80 in place. Coil 80 is energized by closing switch 90, which (like switch 26) is preferably one of the dashboard controls operable by the driver of the vehicle equipped with engine brake 10. A ferromagnetic plate or armature 84 is attached to the upper end of movable central rod 76 so that when an electrical current is passed through coil 80, the magnetic field produced by the coil pulls plate 84 down. As shown in FIG. 3, this causes the lower end of rod 76 to extend from the bottom of sleeve 72 by a predetermined amount. The magnetic force thus exerted by coil 80 is strong enough to overcome the force of slave piston return springs 64, thereby moving slave piston 60 down and reducing the size of clearance C. When thus extended, rod 76 provides a new return stop position for slave piston 60. This has the effect of advancing the timing of the openings of exhaust valve 140 produced by the engine brake because slave piston 60 does not have to travel as far in response to an input from master piston 50 before beginning to open the exhaust valve. For example, clearance C may be closed sufficiently to advance each opening of exhaust valve 140 from an optimized engine retarding crank angle of about 20°–30° before top dead center of the associated engine cylinder compression stroke (when coil 80 is unenergized and the lower end of sleeve 72 therefore provides the return stop position for slave piston 60) to an optimized noise-control engine crank angle of about 60°–70° before top dead center of that cylinder (when coil 80 is energized and the lower end of rod 76 therefore provides the return stop position for slave piston 60). Advancing exhaust valve openings from about 20–30° to about 60°–70° before top dead center may reduce by about 75% the pressure of the gas in the engine cylinder when exhaust valve 140 opens. This dramatically reduces the engine exhaust noise associated with operation of the engine brake. However, it still typically preserves from about one-half to about two-thirds of the engine braking horsepower available when the exhaust valves are opened at about 20°–30° before top dead center. As soon as switch 90 is re-opened, engine brake 10 returns to its initial lash setting and therefore to its full engine braking capability, albeit with the usual higher engine exhaust noise.

It will be understood that the foregoing is only illustrative of the principles of this invention and that various modifications can be made by those skilled in the art without departing from the scope and spirit of the invention. For example, the particular engine crank angle values mentioned above are merely illustrative, and different engine crank angles may be associated with the optimized engine retarding and optimized noise-control modes of other engine and engine brake combinations. As another illustration of modifications within the scope of the invention, use of a solenoid 80 to adjust the timing of exhaust valve openings to control engine exhaust noise associated with operating an engine brake is only an example of how this can be accomplished in accordance with this invention. Other hydraulic, pneumatic, electromagnetic, or mechanical means can be used instead of solenoids if desired.

The invention claimed is:

1. In a compression release engine brake for braking an associated internal combustion engine by using a first mechanical motion of the engine to cause an exhaust valve of the engine to open near the end of a compression stroke of an engine cylinder associated with said exhaust valve, said engine brake including an output member which acts on an exhaust valve mechanism in response to said first mechanical motion in order to open said exhaust valve, said output member being normally spaced from said exhaust valve mechanism during braking operation by a predetermined clearance, said clearance producing a delay between the commencement of said first mechanical motion and the opening of said exhaust valve, the improvement comprising:

clearance selection means operable by a human operator of said engine during operation of said engine; and means responsive to said clearance selection means for modifying said clearance to modify the delay between the commencement of said first mechanical motion and the opening of said exhaust valve, said clearance having a first predetermined dimension during normal engine braking operation of said engine brake, and wherein said means for modifying changes the dimension of said clearance from said first predetermined dimension to a second predetermined dimension which produces an amount of engine braking which is lower than the amount of engine braking produced during said normal engine braking operation.

2. The apparatus defined in claim 1 wherein said second predetermined dimension is less than said first predetermined dimension.

3. The apparatus defined in claim 1 wherein said engine produces a first amount of exhaust noise associated with opening said exhaust valve when said clearance has said first predetermined dimension, and wherein said engine produces a second amount of exhaust noise associated with opening said exhaust valve when said clearance has said second predetermined dimension.

4. The apparatus defined in claim 3 wherein said first amount of exhaust noise is more than said second amount of exhaust noise.

5. The apparatus defined in claim 1 wherein said output member is a slave piston in a hydraulic circuit in said engine brake, said slave piston being forced toward said exhaust valve mechanism to open said exhaust valve by a hydraulic pulse in said hydraulic circuit, and said slave piston being returned to a starting rest position by return spring means when said hydraulic pulse concludes, said means for selectively modifying comprising means for adjusting the location of said rest position relative to said exhaust valve mechanism.

6. The apparatus defined in claim 5 wherein said return spring means presses said slave piston against a stop member in order to place said slave piston in said rest position, and wherein said means for selectively modifying comprise means for moving said stop member.

7. The apparatus defined in claim 6 wherein said means for moving said stop member comprises a solenoid.

8. The apparatus defined in claim 7 wherein said solenoid has a movable armature member, and wherein said stop member is connected to said armature member.

9. The apparatus defined in claim 1 wherein said first predetermined clearance causes said exhaust valve to open at a first predetermined engine crank angle prior to top dead center of the engine piston in said engine cylinder, and wherein said second predetermined clearance causes said exhaust valve to open at a second predetermined engine crank angle prior to top dead center of said engine piston.

10. The apparatus defined in claim 9 wherein said first predetermined engine crank angle is closer. to top dead center than said second predetermined engine crank angle.

11. The apparatus defined in claim 10 wherein said second predetermined engine crank angle is approximately 60°–70° prior to top dead center, and wherein said first predetermined engine crank angle is substantially less than 60°.

12. The apparatus defined in claim 10 wherein said first predetermined engine crank angle is approximately 20°–30° prior to top dead center, and wherein said second predetermined engine crank angle is substantially greater than 30°.

13. The apparatus defined in claim 12 wherein said second predetermined engine crank angle is approximately 60°–70° prior to top dead center.

* * * * *